US008523029B2

(12) United States Patent
Rogers et al.

(10) Patent No.: US 8,523,029 B2
(45) Date of Patent: Sep. 3, 2013

(54) ATTACHMENT MOUNT SYSTEM FOR REMOVABLY SECURING ARTICLES TO MOLLE/PALS-COMPLIANT GARMENTS

(75) Inventors: William H. Rogers, St. Augustine, FL (US); Matthew E. McKendrick, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 1268 days.

(21) Appl. No.: 12/316,555

(22) Filed: Dec. 12, 2008

(65) Prior Publication Data

US 2012/0175390 A1 Jul. 12, 2012

Related U.S. Application Data

(60) Provisional application No. 61/007,856, filed on Dec. 17, 2007, provisional application No. 61/007,855, filed on Dec. 17, 2007.

(51) Int. Cl.

| | |
|---|---|
| ***A45F 5/00*** | (2006.01) |
| ***A45F 3/00*** | (2006.01) |
| ***A01K 97/04*** | (2006.01) |
| ***A45C 1/04*** | (2006.01) |
| ***A44B 6/00*** | (2006.01) |

(52) U.S. Cl.

USPC ..... 224/182; 224/191; 224/197; 224/269; 224/665; 224/666; 224/675; 24/3.7

(58) Field of Classification Search

USPC ..... 224/182, 191, 269, 197, 198; 29/426.2, 29/453; 24/3.7, 614, 615, 625, 629, 647; 2/94, 336

See application file for complete search history.

(56) References Cited

U.S. PATENT DOCUMENTS

| | | | | |
|---|---|---|---|---|
| 1,589,074 | A * | 6/1926 | Harris | 224/235 |
| 2,509,726 | A * | 5/1950 | Dauvergne | 63/1.17 |
| 3,131,445 | A * | 5/1964 | Lorber | 24/67.9 |
| 4,480,356 | A * | 11/1984 | Martin | 24/67.9 |
| 5,144,725 | A * | 9/1992 | Krauss | 24/625 |
| 5,724,707 | A * | 3/1998 | Kirk et al. | 24/3.7 |
| 5,839,167 | A * | 11/1998 | Wagner | 24/3.7 |
| 6,351,876 | B1 * | 3/2002 | Uehara | 24/625 |
| 6,460,232 | B2 * | 10/2002 | Maruoka | 24/615 |
| 6,507,982 | B2 * | 1/2003 | Kawamura | 24/615 |
| 6,728,999 | B2 * | 5/2004 | Murai et al. | 24/615 |
| 7,100,252 | B2 * | 9/2006 | Anscher | 24/615 |
| 7,111,368 | B2 * | 9/2006 | Matoba | 24/615 |
| 7,320,160 | B2 * | 1/2008 | Uehara et al. | 24/615 |
| 7,340,809 | B2 * | 3/2008 | Tracy et al. | 24/615 |
| 2001/0013159 | A1 * | 8/2001 | Maruoka | 24/615 |
| 2002/0017011 | A1 * | 2/2002 | Kawamura | 24/615 |
| 2003/0014851 | A1 * | 1/2003 | Murai et al. | 24/615 |
| 2003/0074772 | A1 * | 4/2003 | Chen | 24/614 |
| 2006/0053600 | A1 * | 3/2006 | Liu | 24/615 |
| 2009/0277936 | A1 * | 11/2009 | Rogers et al. | 224/191 |

* cited by examiner

*Primary Examiner* — Nathan J Newhouse
*Assistant Examiner* — Lester L Vanterpool
(74) *Attorney, Agent, or Firm* — Arthur G. Yeager

(57) ABSTRACT

An attachment mount for removably attaching articles to a MOLLE/PALS-compliant garment or the like. The mount is unitary with openings for affixing an article. A pair of resiliently compressible outer tines with a barb are compressed inwardly to be inserted through a pair of adjacent loops in a first horizontal webbing and then into a vertically-aligned pair of adjacent loops in a second webbing. Upon exiting the loops of the second webbing, the barbs spring outwardly to catch upon a lower edge at spaced stitched areas of the second webbing. Inner tines are directed overtop of the first webbing and into the same loops in the second webbing occupied by the outer tines, with the stitched area between the loops straddled by the inner tines.

20 Claims, 6 Drawing Sheets

ATTACHMENT MOUNT SYSTEM FOR REMOVABLY SECURING ARTICLES TO MOLLE/PALS-COMPLIANT GARMENTS

CROSS-REFERENCE TO RELATED APPLICATION

This application claims priority to provisional application 61/007,856, filed Dec. 17, 2007, entitled Attachment Mount for Accessories onto MOLLE/PALS Garments, and claims priority to provisional application 61/007,855, filed Dec. 17, 2007, entitled Multi-Mount Systems for Accessories Attachable to Garments.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates generally to connectors, fasteners, and attaching systems to secure articles to a garment or the like, and more particularly to an attachment mount for quickly removing and securing holsters, pouches, or other modular accessories to a MOLLE/PALS-compliant garment or a similarly designed garment.

2. Relevant Art

MOLLE is an acronym for MOdular Lightweight Load-carrying Equipment and defines the current generation of load-bearing equipment and rucksacks utilized by the United States Army. The modularity of the system is derived from the use of Pouch Attachment Ladder System or PALS webbing, rows of heavy-duty nylon precisely stitched onto the vest so as to allow for attachment of various MOLLE-compatible pouches and articles. This method of attachment has generally become a standard for all quality modular military gear, replacing the click and stick system used in the earliest modular vest systems (which is still in use by most Western police departments), and is produced for the United States Government under contract by several contractors. See, for example, U.S. Pat. No. 5,724,707.

PALS is a grid of webbing invented and patented by the United States Army Natick Soldier Research. Development, and Engineering Center and is used to attach smaller equipment onto load-bearing platforms, such as vests and backpacks. See, for example, U.S. Pat. Nos. 7,080,430; 7,200,871; and 7,240,404. PALS webbing was first used on MOLLE rucksacks, but is now found on a variety of American equipment, such as the Improved Outer Tactical Vest, Interceptor body armor, USMC Improved Load Bearing Equipment backpack and Modular Tactical Vest. PALS webbing is used to readily attach items such as holsters, magazine pouches, radio pouches, knife sheaths, and other gear. A wide variety of pouches are commercially available, allowing soldiers to customize their kit. There are also a variety of attachment methods, including the Malice Clip, the Natick snap, and soft, interwoven straps. The PALS system has been adopted by other forces, such as the British Army, who use it on their Osprey body armor.

The PALS webbing grid consists of horizontal rows of one inch Mil-W-43668 Type III nylon webbing (most commercial vendors use Type IIIa), spaced one inch apart, and reattached by reinforced stitches or seams to the backing at one and one-half inch intervals.

There have been numerous designs developed so that the user can securely attach an article to the MOLLE/PALS system. These designs can take considerable time to secure and remove the article. Most of the new designs use additional parts to interlock to the PALS system, while the older products use lacing fabric straps. These designs are secure but in many cases are unstable, allowing for a great deal of movement. For articles such as hydration bags or radio pouches movement is usually not a detriment. However, attachment of a pistol holster for quick deployment of the pistol can be a different matter.

The holster should be on a stable mount so that the user can quickly get a proper grip on the pistol and release the pistol from the holster. There is also a need to be able to quickly remove the holster from the PALS webbing without first removing the garment from the user's body. Once removed, it should be possible to quickly place the holster on some other part of the garment or on a different compatible garment worn on the body. While users are traveling in vehicles, it can be advantageous to wear the pistol on the front of the vest, but once deployed and on foot the user might prefer the pistol be mounted elsewhere on the body. Present attachment designs require the removal of the garment in order to remove the article, or they require a secondary receiver member to remain attached to the garment. The article in such a case has a part that matches the receiver member and can be quickly detached; however, the receiver member stays attached to the garment and takes up space.

SUMMARY OF THE INVENTION

The present invention provides an attachment mount that allows the user to quickly mount articles to a MOLLE/PALS-compliant garment or similarly designed garment in a stable manner without removing the garment first. A compliant garment will have a grid of horizontal rows of nylon webbing spaced apart at precise repeated dimensions. The webbings will have spaced loops of repeated dimensions, with the loops of each webbing vertically aligned. The attachment mount itself is a unitary part that may be riveted or bolted to an article that is to be carried on the garment. The attachment mount is normally attached to and detached from the garment while the user is still wearing the garment. For example, if a user is equipped with a MOLLE/PALS-compliant vest, and if there is a PALS system adapted to the waist or leg, then an article can be quickly detached from the vest and reattached to the waist or leg without the use of tools or time-consuming delays.

The attachment mount is affixed to an article and remains with the article when it is moved. As a result, when the article is removed from a garment, no parts remain behind where the article was attached. A second article attached to another attachment mount—an article such as a magazine pouch—can be quickly mounted on the garment at the location where the first article was removed. This capability allows the user to quickly organize the garment for a specific mission.

A lower portion of the attachment mount is shaped generally like the end of a dinner fork with four tines that are approximately parallel to each other and in the same plane. The tines are resilient, with the two outer tines generally longer than the two inner tines. Each of the two outer tines has a barb located toward the bottom of the tine. Each barb extends outwardly from an outer tine such that the lower portions of the outer tines must be compressed inwardly towards each other before the outer tines can be withdrawn from loops of a webbing.

While the lower portion of the attachment mount is shaped somewhat like an end of a dinner fork, the upper and middle portions of the attachment mount can take on other configurations, depending upon a particular embodiment. One embodiment of an attachment mount has an elongated upper portion. Openings in the upper and middle portions of this embodiment are used for attaching an article to the mount. The openings are arranged such that the attachment mount can be attached to the article at a variety of different angles. Another embodiment of an attachment mount has a shorter upper portion. Openings and a spline in the middle portion of this embodiment are used for attaching an article to the mount. The spline allows the attachment mount to be attached to the article at a greater number of angles.

The attachment mount most often attaches vertically to a garment, with the four tines facing downwardly. To attach the attachment mount to the garment, the outer tines of the attachment mount are first inserted through a pair of adjacent loops of a first webbing and then through a pair of adjacent loops of a second webbing. The second webbing is both parallel and proximate to the first webbing, with the pair of loops of the first webbing in a direct line with the pair of loops of the second webbing.

When inserting the outer tines into the loops of the first webbing, however, the inner tines are forwardly angled so that they pass over the top of the first webbing as the attachment mount is pushed further downward. The lower portions of the outer tines become compressed inwardly toward the two inner tines as the outer tines are pushed through the pair of loops of the first webbing. As the barbs of the outer tines exit the first webbing, and again as the barbs later exit the second webbing, the outer tines spring outwardly moving the barbs outwardly as well. At this point, each barb will catch upon a lower edge of a respective webbing if an attempt is made to pull up on the attachment mount without first inwardly compressing the outer tines. This prevents the inadvertent withdrawal of the attachment mount in the reverse direction. As the attachment mount is moved downwardly into the pair of loops of the second webbing, the inner tines pass over the top of the first webbing and into the same pair of adjacent loops in the second webbing as are occupied by the outer tines. The barb of each outer tine exits the pair of loops of the second webbing and engages a lower edge of the second webbing. This positions the middle portion of the attachment mount atop a stitch area between the pair of adjacent loops of the first webbing.

The resulting position of the middle portion of the attachment mount, coupled with the locking action of the barbs of the outer tines on the lower edge of the second webbing, locks the attachment mount firmly in place. The attachment mount remains locked in position until released from the garment.

To release the attachment mount from the garment, the outer tines are squeezed inwardly until the barbs of the outer tines are within the bounds of the loops of the second webbing. While still squeezing the outer tines inwardly, the attachment mount is lifted out of the first and second webbings, thereby detaching the attachment mount from the garment. Note that removal of the attachment mount can be effected quickly. It can also be effected while still wearing the garment. Note also that such quick removal of the attachment mount can also be accomplished using only one hand and while wearing the garment.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PRESENT INVENTION

Figure 3:
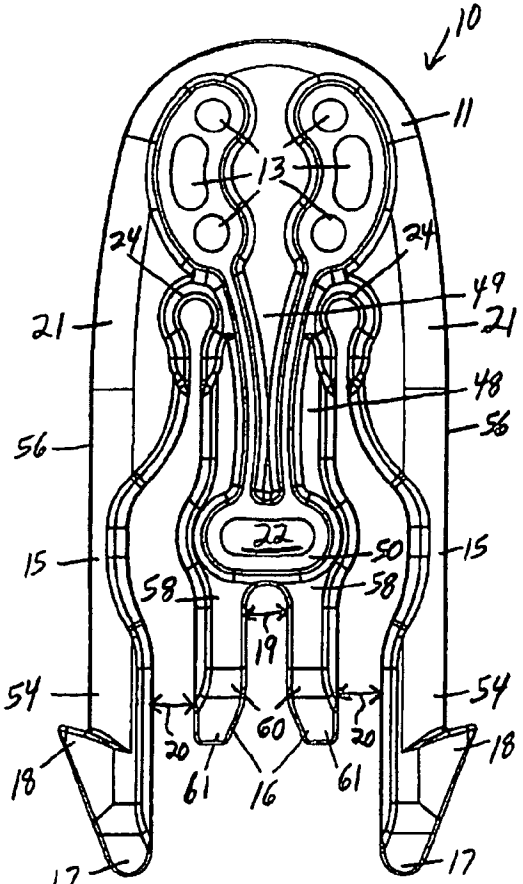
FIG. 3 is a front elevational view of FIG. 1.
Figure 2:
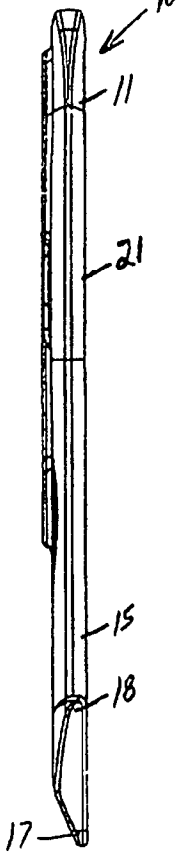
FIG. 2 is a left side elevational view of FIG. 1.
Figure 1:
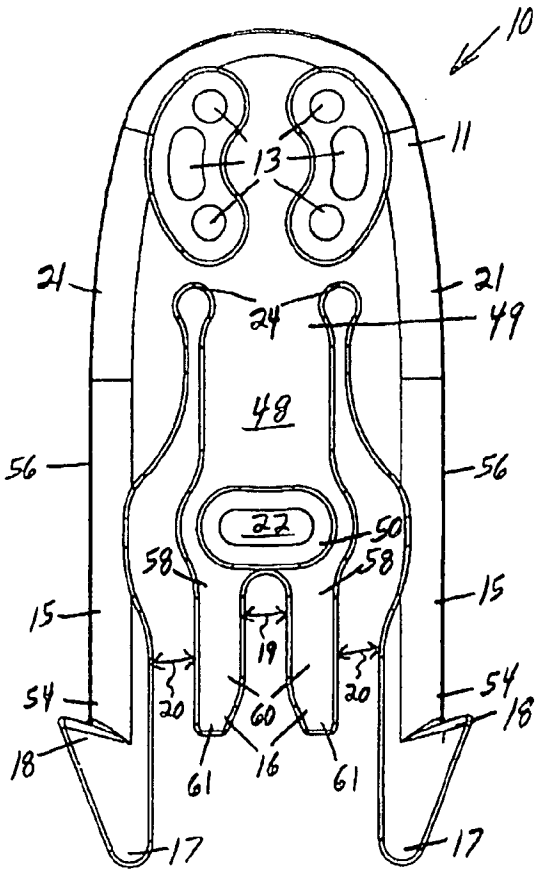
FIG. 1 is a rear elevational view of an attachment mount in accord with the present invention.
Figure 4:
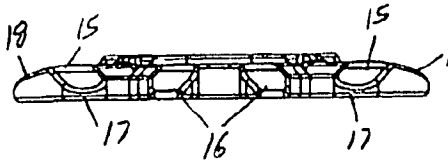
FIG. 4 is a bottom plan view of FIG. 1.
Figure 5:
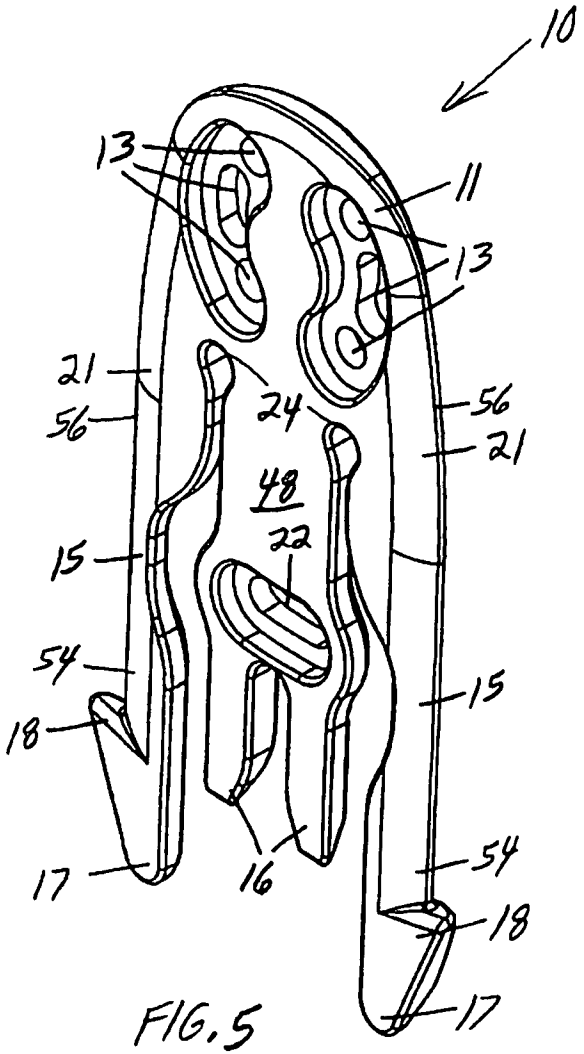
FIG. 5 is a rear perspective view of FIG. 1.
Figure 6:
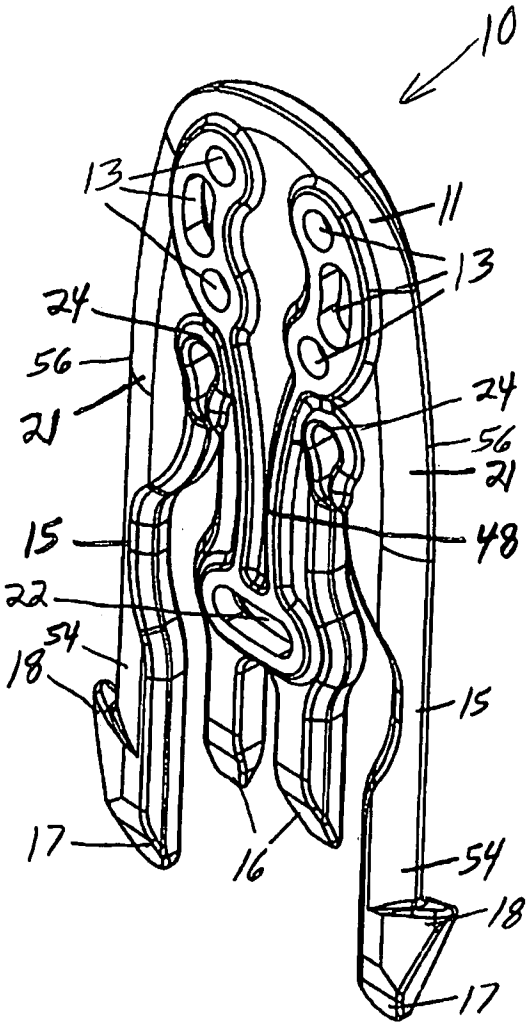
FIG. 6 is a front perspective view of FIG. 1.

Embodying the principles of the present invention is an attachment mount, a preferred embodiment of which is depicted in FIGS. 1-8 and designated generally by reference numeral 10.

Referring now to FIGS. 1-6, a substantially planar attachment mount 10 is formed of a hard, resilient plastic material. The attachment mount 10 comprises an upper portion 11 (see FIGS. 1, 2, 3, 5, and 6); an inner tine body 48 (see FIGS. 1, 3, 5, and 6) with an upper portion 49 (see FIGS. 1 and 3) and a lower portion 50 (see FIGS. 1 and 3); a spaced pair of outer tines 15, each outer tine 15 having an outer edge 56 (see FIGS. 1, 3, 5, and 6), an upper portion 21 (see FIGS. 1, 2, 3, 5, and 6), and a lower portion 54 (see FIGS. 1, 3, 5, and 6); and a spaced pair of inner tines 16 (see FIGS. 1, 3, 5, and 6), each inner tine 16 having an upper portion 58 (see FIGS. 1 and 3) and a lower portion 60 (see FIGS. 1 and 3). The attachment mount 10 also includes two junctions 24 (see FIGS. 1, 3, 5, and 6). Each of the two junctions 24 is located where the upper portion 21 of an outer tine 15 meets the upper portion 49 of the inner tine body 48.

Continuing with FIGS. 1-6, the upper portion 58 of each inner tine 16 is formed integrally with the lower portion 50 of the inner tine body 48. The upper portion 21 of each outer tine 15 is formed integrally with the upper portion 11 of the attachment mount 10. The pair of outer tines 15 bracket both of the inner tines 16 as well as the inner tine body 48 of the attachment mount 10 and are also spaced from the inner tines 16 and the inner tine body 48. The four tines 15, 16 are generally parallel to each other and lie in the same plane, such that the four tines 15, 16 somewhat resemble an end of a dinner fork, although the outer tines 15 are longer than the inner tines 16. The hard, resilient plastic material of the attachment mount 10, combined with the spacing 20 between the outer tines 15 and the inner tines 16, permits the outer tines 15 to be compressed inwardly towards each other. Upon release, the outer tines 15 spring back to their former positions.

Still referring to FIGS. 1-6, the upper portion 21 of each outer tine 15 is wider than the remainder of the outer tine 15, and each outer tine 15 has a rounded tip 17. A barb 18 is located at the lower portion 54 of each outer tine 15 as well. The barb 18 extends outwardly from the outer edge 56 of each respective outer tine 15. Note that when securing the attachment mount 10 to the MOLLE/PALS-compliant garment 25, each barb 18 extends beyond an outer edge of a respective loop 29 thereby helping to secure the attachment mount 10 to the garment 25, as described below with reference to FIG. 13.

Regarding FIGS. 1-6, in the present embodiment the height of the attachment mount 10, including the outer tines 15, is about three times the combined heights of a loop 29 (see FIG. 13) and a space between webbings 26 (see FIG. 13), or approximately six inches. The width of the attachment mount 10 is about the width of two loops 29, or approximately three inches. The distance between the barbs 18 of the outer tines 15 is about three and seven-sixteenths inches. The spacing 19 between the inner tines 16 is about one-quarter of an inch. The spacing 20 between each inner tine 16 and a respective outer tine 15 is also about one-quarter of an inch. As alluded to earlier, the outer tines 15 can be compressed inwardly such that the distance between the barbs 18 is temporarily diminished, allowing the outer tines 15 and the inner tines 16 to both be inserted into the same pair of adjacent loops 29 in a webbing 26, as described below with reference to FIG. 13.

Figure 8:
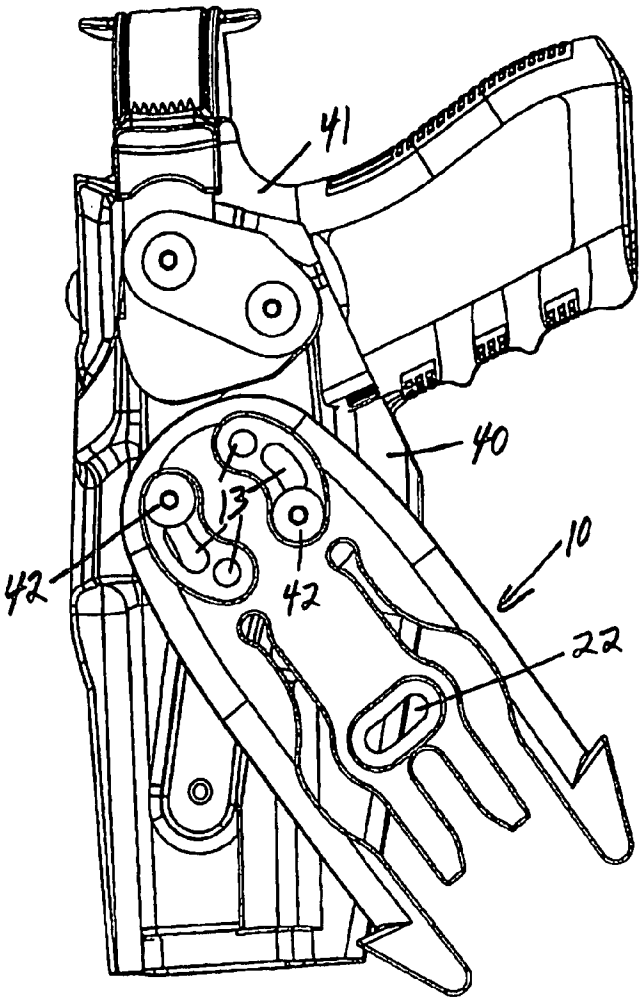
FIG. 8 is a view similar to FIG. 7 but with the holster at an angle to the vertical relative to the attachment mount of FIG. 1.
Figure 7:
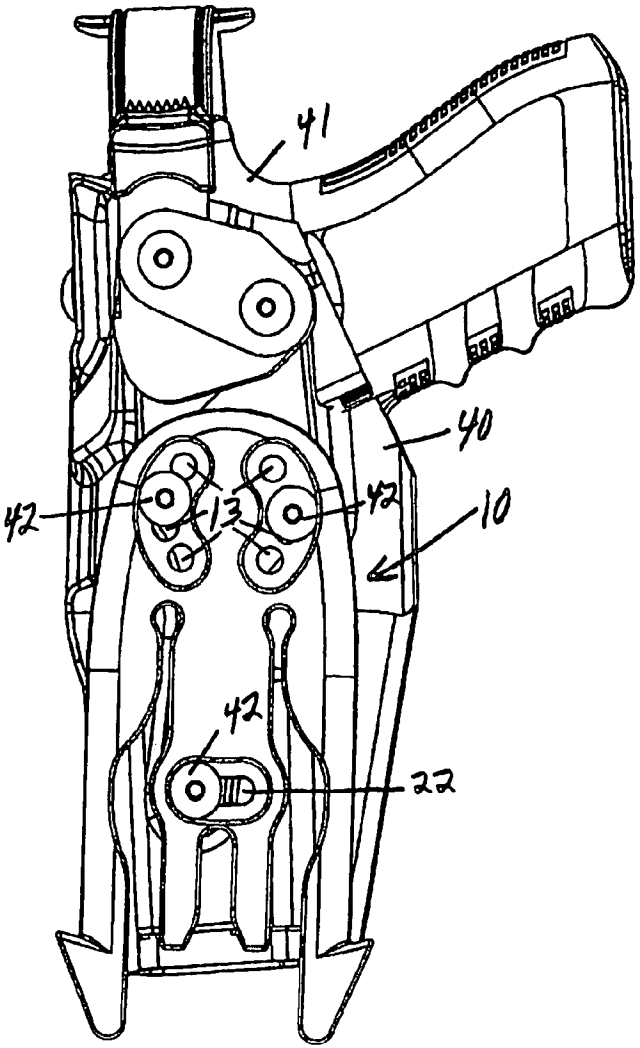
FIG. 7 is a rear elevational view of the attachment mount of FIG. 1 connected to a holster for a handgun in a vertical position.

Referring now to FIGS. 7 and 8, the upper portion 11 (see FIGS. 1, 2, 3, 5, and 6) of the attachment mount 10 includes a hole pattern 13 containing a plurality of holes and slots. The inner tine body 48 (see FIGS. 1, 3, 5, and 6) of the attachment mount 10 includes a horizontal slot 22. Together, the hole pattern 13 and the horizontal slot 22 are used to affix an article, such as a holster 40 with handgun 41, to the attachment mount 10.

Continuing with FIGS. 7 and 8, fasteners 42, such as rivets or T-nuts and bolts, are passed through selected openings of the hole pattern 13 and horizontal slot 22 and used to fasten the holster 40, or other article, to the attachment mount 10. As shown in FIG. 7, the holster 40 may be mounted to the attachment mount 10 so as to be substantially aligned with the mount 10. As shown in FIG. 8, the holster 40 may also be mounted to the attachment mount 10 so as to be at an angle relative to the mount 10. The openings of the hole pattern 13, together with the horizontal slot 22, allow for the holster 40 to be mounted at a variety of possible angles, as is well known in the art. The holster 40 and attachment mount 10 are normally positioned on a garment 25 (see FIG. 13) at a comfortable or appropriate angle. One factor in determining the resulting angle is the type of MOLLE/PALS-compliant garment 25 worn, such as a vest or a waist or leg band.

Figure 10:
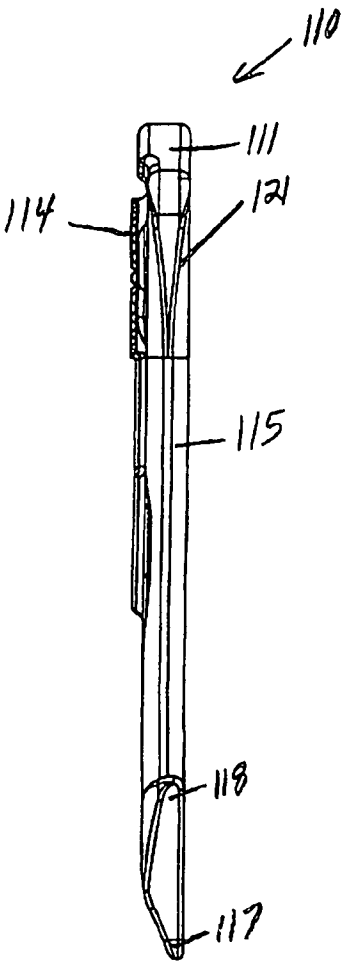
FIG. 10 is a left side elevational view of FIG. 9.
Figure 9:
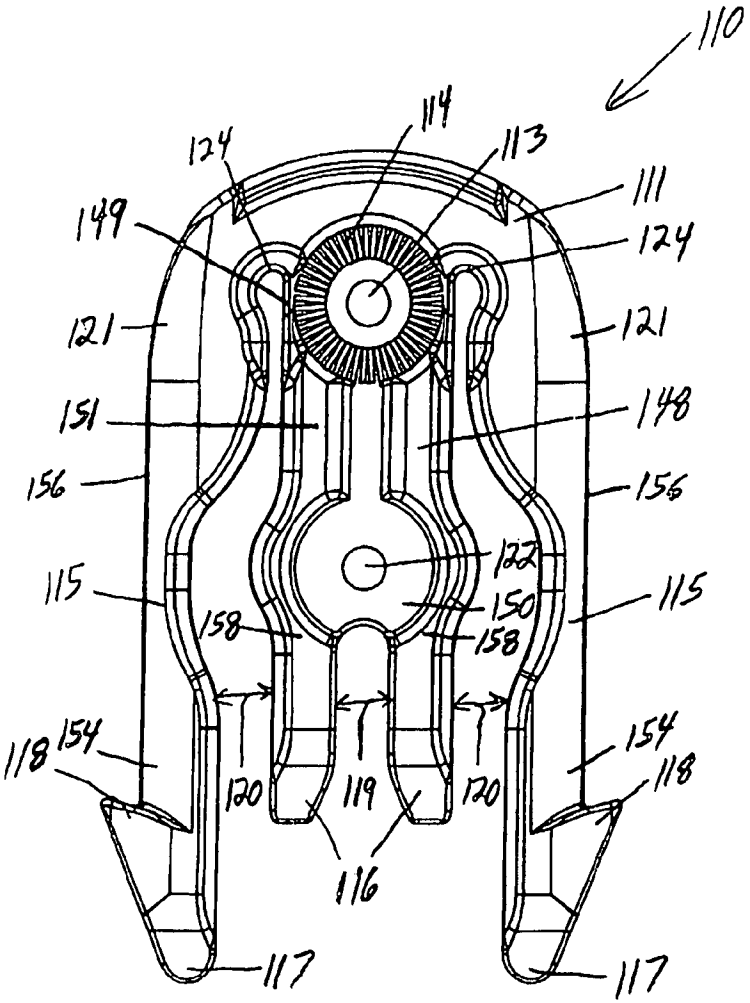
FIG. 9 is a front elevational view of a second embodiment of an attachment mount, in accord with the present invention.

FIGS. 9 and 10 depict a second preferred embodiment of an attachment mount, designated generally by reference numeral 110. The attachment mount 110 of the present embodiment provides a further way of affixing an article to the attachment mount 110 at a variety of possible angles relative to the mount 110 and of removably securing the article to a MOLLE/PALS-compliant garment 25 (see FIG. 13).

Referring now to FIGS. 9 and 10, the substantially planar attachment mount 110 is formed of a hard, resilient plastic material. The attachment mount 110 comprises an upper portion 111; an inner tine body 148 (see FIG. 9) with a front surface 151 (see FIG. 9), an upper portion 149 (see FIG. 9), and a lower portion 150 (see FIG. 9); a spaced pair of outer tines 115, each outer tine 115 having an outer edge 156 (see FIG. 9), an upper portion 121 (see FIG. 9), and a lower portion 154 (see FIG. 9); and a spaced pair of inner tines 116 (see FIG. 9), each inner tine 116 having an upper portion 158 (see FIG. 9) and a lower portion 160 (see FIG. 9). The attachment mount 110 also includes two junctions 124 (see FIG. 9). Each of the two junctions 124 is located where the upper portion 121 of an outer tine 115 meets the upper portion 149 of the inner tine body 148.

Continuing with FIGS. 9 and 10, the upper portion 158 of each inner tine 116 is formed integrally with the lower portion 150 of the inner tine body 148. The upper portion 121 of each outer tine 115 is formed integrally with the upper portion 111 of the attachment mount 110. The pair of outer tines 115 bracket both of the inner tines 116 as well as the inner tine body 148 of the attachment mount 110 and are also spaced from the inner tines 116 and the inner tine body 148. The four tines 115, 116 are generally parallel to each other and lie in the same plane, such that the four tines 115, 116 somewhat resemble an end of a dinner fork, although the outer tines 115 are longer than the inner tines 116. The hard, resilient plastic material of the attachment mount 110, combined with the spacing 120 between the outer tines 115 and the inner tines 116, permits the outer tines 115 to be compressed inwardly towards each other. Upon release, the outer tines 115 spring back to their former positions.

Still referring to FIGS. 9 and 10, the upper portion 21 of each outer tine 115 is wider than the remainder of the outer tine 115, and each outer tine 115 has a rounded tip 117. A barb 118 is located at the lower portion 154 of each outer tine 115 as well. The barb 118 extends outwardly from the outer edge 156 of each respective outer tine 115. Note that when securing the attachment mount 110 to the MOLLE/PALS-compliant garment 125, each barb 118 extends beyond an outer edge of a respective loop 29 thereby helping to secure the attachment mount 110 to the garment 25, as described below with reference to FIG. 13.

Continuing with FIGS. 9 and 10, the upper portion 149 of the inner tine body 148 of the attachment mount 110 includes a locking spline 114 encircling an attaching hole 113 (see FIG. 9). The spline 114 is formed integrally with the front surface 151 of the inner tine body 148. The spline 114 is capable of engaging a compatible spline of an article while a connector (not shown) can be passed through the attaching hole 113 to affix the article to the attachment mount 110. The article can be affixed to the attachment mount 110 in a number of angled positions. The spline 114 permits angular relationships in increments of approximately fifteen degrees between the attachment mount 110 and the article. The lower portion 150 of the inner tine body 148 of the attachment mount 110 also includes an attaching hole 122 (see FIG. 9). This hole 122 can be used by itself or in conjunction with the spline 114 and the attaching hole 113 of the upper portion 149 of the inner tine body 148 for affixing the article to the attachment mount 110, as is well known in the art.

Regarding FIGS. 9 and 10, in the second preferred embodiment of the present invention, the height of the upper portion 111 of the attachment mount 110 is less than the height of the upper portion 11 of the attachment mount 10 of the first preferred embodiment (see FIGS. 1-6). The inner tine body 148, the outer tines 115, and the inner tines 116 of the attachment mount 110 of the second preferred embodiment, however, are all of substantially the same dimensions as their counterparts in the first preferred embodiment. Given this, the distance between the barbs 118 of the outer tines 115 is about three and seven-sixteenths inches. The spacing 119 between the inner tines 116 is about one-quarter of an inch. And the spacing 120 between each inner tine 116 and a respective outer tine 115 is also about one-quarter of an inch. This means that the outer tines 115 can be compressed inwardly such that the distance between the barbs 118 is temporarily diminished, allowing the outer tines 115 and the inner tines 116 to both be inserted into the same pair of adjacent loops 29 in a webbing 26, as described below with reference to FIG. 13.

Figure 12:
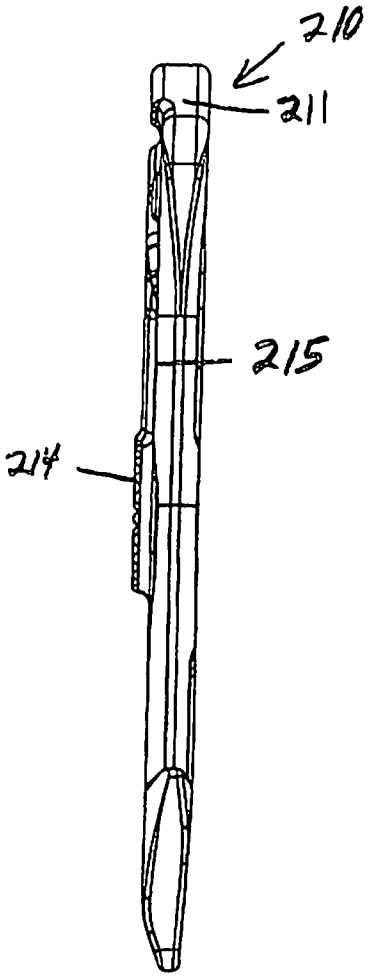
FIG. 12 is a left side elevational view of FIG. 11.
Figure 11:
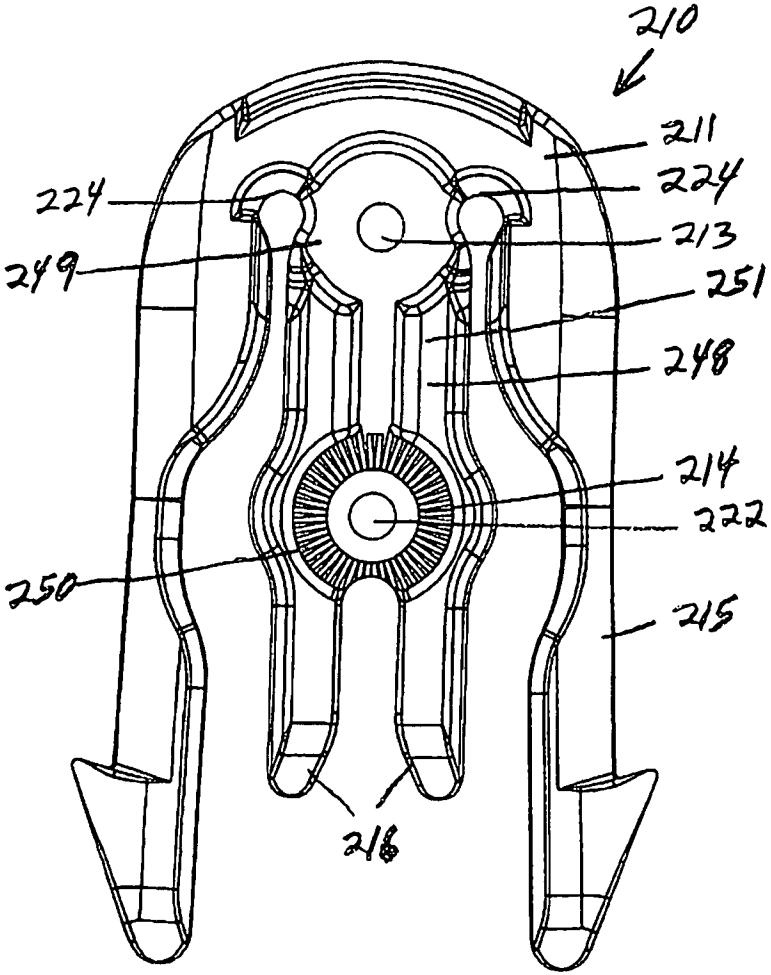
FIG. 11 is a front elevational view of a third embodiment of an attachment mount, in accord with the present invention.

FIGS. 11 and 12 depict a third preferred embodiment of an attachment mount, designated generally by reference numeral 210. The attachment mount 210 of the present embodiment and the attachment mount 110 of the second preferred embodiment (see FIGS. 9 and 10) are substantially the same, save for the location of a locking spline 214 in the attachment mount 210 of the present embodiment.

Referring now to FIGS. 11 and 12, the attachment mount 210 comprises an upper portion 211; an inner tine body 248 (see FIG. 11) with a front surface 251 (see FIG. 11), an upper portion 249 (see FIG. 11), and a lower portion 250 (see FIG. 11); a spaced pair of outer tines 215; and a spaced pair of inner tines 216 (see FIG. 11). The attachment mount 210 also includes two junctions 224 (see FIG. 11). Each of the two junctions 224 is located where the upper portion 221 of an outer tine 215 meets the upper portion 249 of the inner tine body 248.

Continuing with FIGS. 11 and 12, the lower portion 250 of the inner tine body 248 includes the locking spline 214 encircling an attaching hole 222 (see FIG. 11). The spline 214 is formed integrally with the front surface 251 of the inner tine body 248. The spline 214 is capable of engaging a compatible spline of an article while a connector (not shown) can be passed through the attaching hole 222 to affix the article to the attachment mount 210. The article can be affixed to the attachment mount 210 in a number of angled positions. The spline 214 permits angular relationships in increments of approximately fifteen degrees between the attachment mount 210 and the article. The upper portion 249 of the inner tine body 248 includes an attaching hole 213 (see FIG. 11). This hole 213 can be used by itself or in conjunction with the spline 214 and the attaching hole 222 of the lower portion 250 of the inner tine body 248 for affixing the article to the attachment mount 210, as is well known in the art.

Figure 13:
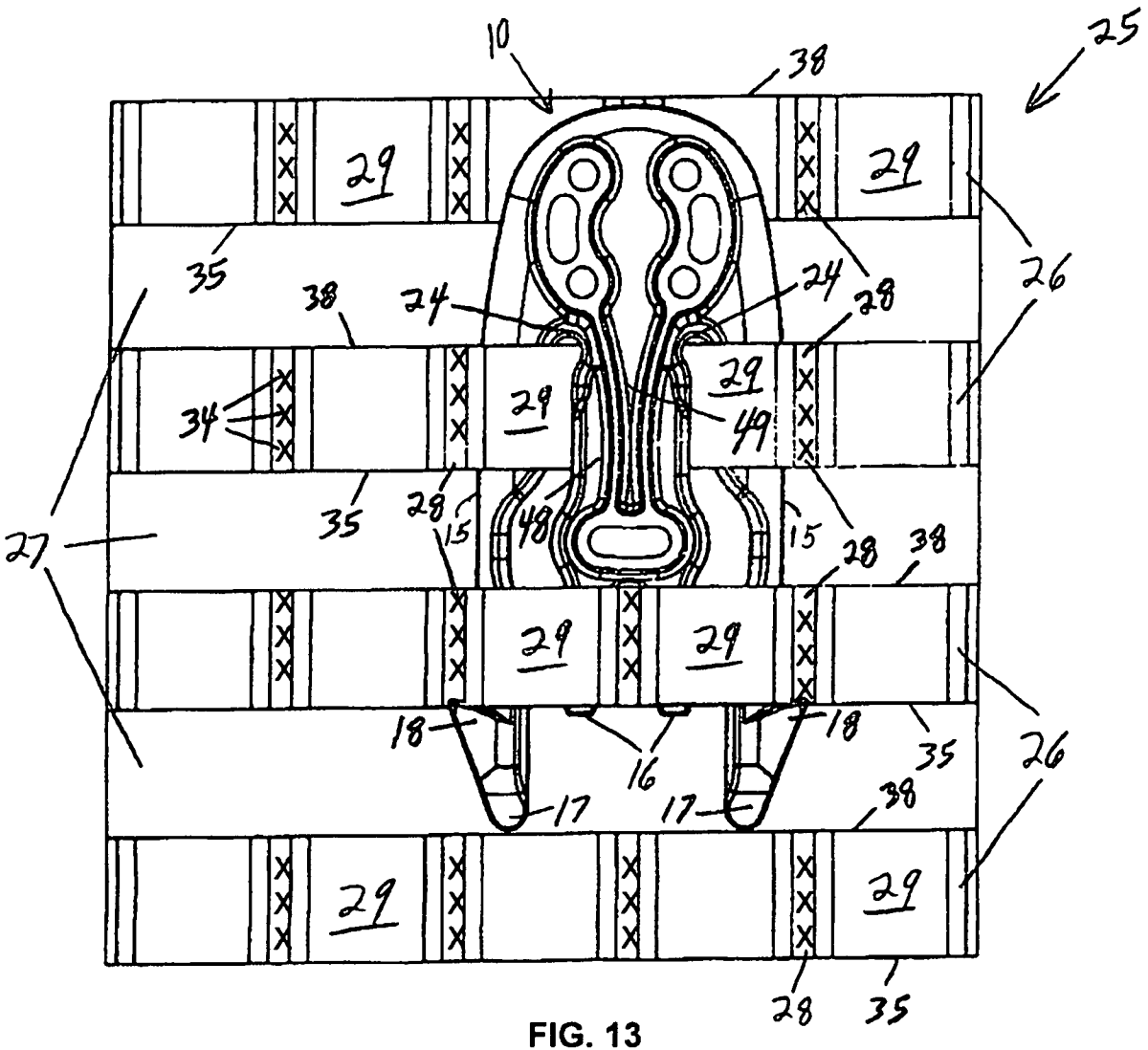
FIG. 13 is a front elevational view of the attachment mount of FIG. 1 properly installed on spaced, horizontal webbings of a garment.

FIG. 13 shows the attachment mount 10 of the first preferred embodiment (see FIGS. 1-6) of the present invention installed on a MOLLE/PALS-compliant garment 25. Note that the attachment mount 110 of the second preferred embodiment (see FIGS. 9 and 10) and the attachment mount 210 of the third preferred embodiment (see FIGS. 11 and 12) are each installed on a MOLLE/PALS-compliant garment 25 in similar fashion.

Referring now to FIG. 13, the MOLLE/PALS-compliant garment 25 comprises a plurality of spaced, horizontally-aligned webbings 26 and a backing 27. Each of the webbings 26 is secured to the backing 27 at equally spaced locations by a plurality of vertical stitch areas 28. The stitch areas 28 are reinforced and multi-seamed so that each webbing 26 is firmly and precisely secured to the backing 27. A vertical loop 29 is formed between each pair of stitch areas 28 in the webbing 26. The loops 29 of one webbing 26 are aligned vertically with the loops 29 of another webbing 26.

Continuing with FIG. 13, the attachment mount 10 most often attaches vertically to the garment 25, with the four tines 15, 16 facing downwardly on the body such that gravity assists in securing the attachment mount 10 to the garment 25. Generally speaking, when attaching the attachment mount 10 to the garment 25, the outer tines 15 of the attachment mount 10 are first inserted through a pair of adjacent loops 29 of a first webbing 26 and then through a pair of adjacent loops 29 of a second webbing 26. The second webbing 26 is both parallel and proximate to the first webbing 26, with the pair of loops 29 of the first webbing 26 in a direct line with the pair of loops 29 of the second webbing 26.

More specifically, the lower portions 54 of the outer tines 15 are first inserted into the pair of adjacent loops 29 of the first webbing 26. Before the lower portions 54 of the outer tines 15 pass completely through these loops 29, however, the inner tines 16 are forwardly angled so that the inner tines 16 pass over the top of the first webbing 26 as the attachment mount 10 is pushed further downward. The lower portions 54 of the outer tines 15 become compressed inwardly toward the two inner tines 16 as the outer tines 15 are pushed through the pair of loops 29 of the first webbing 26. As the barbs 18 of the outer tines 15 exit the first webbing 26, and again as the barbs 18 later exit the second webbing 26, the outer tines 15 spring outwardly moving the barbs 18 outwardly as well. Note that at this point, each barb 18 will catch upon a lower edge 35 of a respective webbing 26 if an attempt is made to pull up on the attachment mount 10 without first inwardly compressing the outer tines 15. This prevents the inadvertent withdrawal of the attachment mount 10 in the reverse direction. As the attachment mount 10 is moved downwardly, the inner tines 16 pass over the top of the first webbing 26 and enter into the pair of adjacent loops 29 in the second webbing 26 below.

Still referring to FIG. 13, each outer tine 15 is wider at an upper portion 21 (See FIGS. !-5) than along any other area of the outer tine 15. Also, a junction 24 is formed where the upper portion 21 of each outer tine 15 meets an upper portion 49 of the inner tine body 48 of the mount 10. When the attachment mount 10 is fully inserted through the pairs of loops 29 of both the first and second webbings 26, the wider width of the upper portions 21 of the outer tines 15 generally fill the spaces within the pair of adjacent loops 29 of the first webbing 26. Each of the two junctions 24 of the attachment mount 10 prevents the attachment mount 10 from being pushed further past the upper edge 38 of the first webbing 26. The barb 18 of each outer tine 15 is spaced at such a distance from a respective junction 24 that when the junction 24 generally abuts the upper edge 38 of the first webbing 26, the barb 18 is engaging a respective lower edge 35 of the second webbing 26.

Continuing with FIG. 13, as the outer tines 15 are being inserted into the pairs of adjacent loops 29 of the first and second webbings 26, the inner tines 16 are being passed over the top of the first webbing 26 and inserted into the same pair of adjacent loops 29 of the second webbing 26 that the outer tines 15 have been inserted into. This positions the upper portion 49 of the inner tine body 48 of the attachment mount 10 atop a stitch area 28 between the pair of adjacent loops 29 of the first webbing 26.

Still referring to FIG. 13, the resulting position of the inner tine body 48 of the attachment mount 10, coupled with the wider upper portions 21 of the outer tines 15 generally filling the pair of adjacent loops 29 of the first webbing 26, creates a bind between the pair of loops 29 of the first webbing 26 and the attachment mount 10. The bind placed upon the pair of loops 29 of the first webbing 26, coupled with the locking action of the barbs 18 on the lower edge 35 of the second webbing 26, locks the attachment mount 10 firmly in place. The attachment mount 10 remains locked in position until released from the garment 25.

Continuing with FIG. 13, to release the attachment mount 10 from the garment 25, the outer tines 15 are squeezed inwardly until the barb 18 of each outer tine 15 clears an outer edge of a respective loop 29 of the second webbing 26. While still squeezing the outer tines 15 inwardly, the attachment mount 10 is then lifted out of the first and second webbings 26, thereby detaching the attachment mount 10 from the garment 25.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An attachment mount for removably securing an article to a garment comprising:

a substantially planar attachment member having a rear surface and a front surface and including an upper portion and an inner tine body narrower in width than said upper portion, said inner tine body extending generally laterally from said upper portion;

said front face between said upper portion and said inner tine body having a raised surface parallel to said front face;

a spaced pair of generally parallel inner tines for removably securing said attachment member to a garment, said inner tines formed integrally with said inner tine body and extending generally laterally therefrom in substantially the same plane; a spaced pair of generally parallel outer tines for removably securing said attachment member to a garment, said outer tines formed integrally with said upper portion of said attachment member and extending generally laterally therefrom in substantially the same plane and bracketing said inner tines and said inner tine body, with each said outer tine spaced from said inner tine body and a proximate one of said inner tines, each said outer tine having an upper portion proximate said upper portion of said attachment member that is wider than a remaining portion of said outer tine for lodging snugly within a loop of a garment, said outer tines being resiliently compressible toward each other, each said outer tine further including a lower portion distal from said upper portion of said outer tine and containing a barb extending generally laterally from an outer edge of said lower portion opposing said inner tines for removably securing said attachment member to a garment; and means for attaching an article to said raised surface of said attachment member.

2. The attachment mount as defined in claim 1, wherein:

said raised front surface of said upper portion of said attachment member includes a plurality of spaced slots and round holes extending therethrough; and said raised surface of said inner tine body of said attachment member includes a slot extending therethrough.

3. The attachment mount as defined in claim 1, wherein:

said front surface includes a pair of spaced attaching holes extending therethrough, and a locking spline formed integrally with said front surface and surrounding a first said attaching hole; and said means for attaching said article to said attachment member include said pair of spaced attaching holes of said inner tine body and said spline of said inner tine body for affixing said article to an attachment member at a plurality of angles relative thereto.

4. The attachment mount as defined in claim 1, wherein:

each said outer tine includes a tip at an end distal from said upper portion of said attachment member;

each said inner tine includes a tip at an end distal from said inner tine body of said attachment member; and said tips of said outer tines extend downwardly beyond said tips of said inner tines.

5. The attachment mount as defined in claim 4, wherein:

said raised surface of said upper portion of said attachment member includes a plurality of spaced slots and round holes extending therethrough;

said raised surface of said inner tine body of said attachment member includes a slot extending therethrough; and said means for attaching an article to said attachment member include said plurality of slots and holes of said upper portion of said attachment member and said slot of said inner tine body for affixing an article to said attachment member at a plurality of angles relative thereto.

6. The attachment mount as defined in claim 4, wherein:

wherein said raised surface includes a pair of spaced attaching holes extending therethrough, and a locking spline formed integrally with said front surface and surrounding a first said attaching hole; and said means for attaching said article to said attachment member include said pair of spaced attaching holes of said inner tine body and said spline of said inner tine body for affixing an article to said attachment member at a plurality of angles relative thereto.

7. The attachment mount as defined in claim 6, wherein said attachment member, said inner tines, said outer tines and said locking spline are all integral and formed of hard plastic, said inner tines and said outer tines being generally parallel to each other.

8. A system for removably securing articles to a garment comprising:

a garment having a plurality of spaced, substantially horizontal webbings, each said webbing secured to said garment at equally spaced apart locations, each said webbing containing a plurality of equally spaced apart, equally sized loops, said loops of a first said webbing being substantially aligned vertically with said loops of remaining said webbings;

a substantially planar attachment mount for removably securing articles to said garment including:

an attachment member including an upper portion and an inner tine body narrower in width than said upper portion, said inner tine body extending generally laterally from said upper portion;

a spaced pair of generally parallel inner tines for removably securing said attachment mount to said garment, said inner tines formed integrally with said inner tine body and extending generally laterally therefrom;

a spaced pair of generally parallel outer tines for removably securing said attachment mount to said garment, said outer tines formed integrally with said upper portion of said attachment member and extending generally laterally therefrom and bracketing said inner tines and said inner tine body with each said outer tine spaced from said inner tine body and a proximate one of said inner tines, each said outer tine having an upper portion proximate said upper portion of said attachment member that is wider than a remaining portion of said outer tine for lodging snugly within said loop of said garment, said outer tines being resiliently compressible toward each other, each said outer tine further including a lower portion distal from said upper portion of said outer tine and containing a barb extending generally laterally from an outer edge of said lower portion opposing said inner tines for removably securing said attachment mount to said garment; and means for attaching an article to said attachment member; and said pair of outer tines being disposed through a pair of adjacent said loops of a first said webbing and through a pair of adjacent said loops of a second proximate said webbing substantially aligned vertically with said pair of adjacent loops of said first webbing, said barb of each said outer tine catching upon a lower edge of said second webbing upon passing of said barbs beyond said lower edge of said second webbing, said pair of inner tines being disposed over said first webbing and through said pair of adjacent loops of said second webbing, an upper portion of said inner tine body of said attachment member distal from said inner tines overlaying said first webbing.

9. The system as defined in claim 8, wherein:

each said outer tine of said attachment mount includes a tip at an end distal from said upper portion of said attachment member of said attachment mount;

each said inner tine of said attachment mount includes a tip at an end distal from said inner tine body of said attachment member of said attachment mount; and said tips of said outer tines extend downwardly beyond said tips of said inner tines.

10. The system as defined in claim 9, wherein:

said upper portion of said attachment member of said attachment mount includes a plurality of spaced slots and holes extending therethrough;

said inner tine body of said attachment member of said attachment mount includes a slot extending therethrough; and said means for attaching an article to said attachment member include said plurality of slots and holes of said upper portion of said attachment member and said slot of said inner tine body for affixing an article to said attachment mount at a plurality of angles relative thereto.

11. The system as defined in claim 9, wherein:

said inner tine body of said attachment member of said attachment mount includes a front surface, a pair of spaced attaching holes extending therethrough, and a locking spline formed integrally with said front surface and surrounding a first said attaching hole; and said means for attaching an article to said attachment member include said pair of spaced attaching holes of said inner tine body and said spline of said inner tine body for affixing an article to said attachment mount at a plurality of angles relative thereto.

12. The system as defined in claim 8, wherein:

said upper portion of said attachment member of said attachment mount includes a plurality of spaced slots and holes extending therethrough; said inner tine body of said attachment member of said attachment mount includes a slot extending therethrough; and said means for attaching an article to said attachment member include said plurality of slots and holes of said upper portion of said attachment member and said slot of said inner tine body for affixing an article to said attachment mount at a plurality of angles relative thereto.

13. The system as defined in claim 8, wherein:

said inner tine body of said attachment member of said attachment mount includes a front surface, a pair of spaced attaching holes extending therethrough, and a locking spline formed integrally with said front surface and surrounding a first said attaching hole; and said means for attaching an article to said attachment member include said pair of spaced attaching holes of said inner tine body and said spline of said inner tine body for affixing said article to an attachment mount at a plurality of angles relative thereto.

14. The system as defined in claim 8, wherein said attachment mount is formed of hard plastic, said inner tines and said outer tines being generally parallel to each other.

15. A method for removably securing articles to a garment, said method comprising the steps of:

A) affixing an article to an attachment mount by passing a fastener through an opening in the attachment mount and using the fastener to secure the article thereto;

B) inserting tips of outer tines of the attachment mount into an adjacent pair of spaced loops in a first horizontally disposed webbing of a garment;

C) angling outwardly tips of inner tines of the attachment mount such that the inner tines pass over the top of the first webbing as the attachment mount is moved toward adjacent loops of a second proximate webbing;

D) moving the attachment mount to position the outer tines through the adjacent loops of the first webbing and into and through the pair of adjacent loops of the second webbing that are aligned vertically with the pair of loops of the first webbing; and E) guiding the tips of the inner tines into the adjacent pair of loops of the second webbing, until a barb of each of the outer tines springs outwardly to catch upon a lower edge of the second webbing at a respective stitch area, thereby securing the attachment mount and the affixed article to the garment.

16. The method as recited in claim 15, wherein step E includes straddling the stitch area between the adjacent loops of the second webbing by the space between the inner tines.

17. The method as recited in claim 15, wherein step A includes the step of:

F) providing a plurality of spaced slots and holes in an upper portion of the attachment member of the attachment mount and a slot in an inner tine body of the attachment member of the attachment mount through which fasteners can be passed and used to secure the article to the attachment mount at a plurality of angles relative thereto.

18. The method as recited in claim 15, wherein step A includes the step of:

F) providing in an inner tine body of the attachment member of the attachment mount a pair of spaced attaching holes and a locking spline surrounding one of the attaching holes through which fasteners can be passed and used to secure the article to the attachment mount at a plurality of angles relative thereto.

19. The method as recited in claim 15, further comprising the step of:

F) compressing inwardly a lower portion of each outer tine of the attachment mount such that the barb of the outer tine clears a respective proximate stitch area at the lower edge of the second webbing, and then withdrawing the attachment mount upwardly out of both the second and first webbings.

20. The method as recited in claim 19, wherein step F includes the step of:

G) maintaining the compression of the outer tines until the outer tines and barbs are located in the loops of the first webbing.

* * * * *